US005452705A

United States Patent [19]

Horng

[11] Patent Number: 5,452,705

[45] Date of Patent: Sep. 26, 1995

[54] THREE-PURPOSE TILE CUTTING PLIERS

[76] Inventor: Jeng-Tsong Horng, No. 55-9, Chung Hsing Rd., Chung Ping Village, Tai Ping Hsiang, Taichung Hsien, Taiwan, Prov. of China

[21] Appl. No.: 358,013

[22] Filed: Dec. 16, 1994

[51] Int. Cl.[6] ..... B28D 1/32

[52] U.S. Cl. ..... 125/23.01; 125/23.02; 225/96.5; 7/158; 30/145

[58] Field of Search ..... 125/23.01, 23.02, 125/24, 36, 38; 7/132, 133, 158; 30/123, 145, 175, 191, 193; 225/6, 7, 89, 90, 91, 94, 95, 96.5

[56] References Cited

U.S. PATENT DOCUMENTS 2,589,501 3/1952 Lenardozzi ..... 125/23.02
4,444,174 4/1984 Hepworth et al. ..... 125/23.02
5,365,915 11/1994 Yu ..... 125/38

FOREIGN PATENT DOCUMENTS 2021036 11/1979 United Kingdom ..... 125/23.02

*Primary Examiner*—Maurina T. Rachuba
*Attorney, Agent, or Firm*—Bacon & Thomas

[57] ABSTRACT

A tile cutting pliers including a base handle and an actuating handle pivotably connected together by a pivot and a return spring and terminating in a respective cutter blade for cutting small tiles, wherein the base handle has a triangular stop bar longitudinally disposed at an inner side; the actuating handle has a scratcher for cutting scratches on big tiles, a jaw plate and two needle holders longitudinally spaced at an inner side and moved relative to the longitudinal stop bar to cut big tiles along the scratches cut thereon.

1 Claim, 5 Drawing Sheets

THREE-PURPOSE TILE CUTTING PLIERS

BACKGROUND OF THE INVENTION

The present invention relates to tile cutting pliers, and relates more particularly to a three-purpose tile cutting pliers which can be used to cut small tiles, to scratch lines on big tiles, and to cut big tiles along the scratches.

A variety of tiles are well known and intensively used in building construction for covering and decorating walls. During a tile covering work, titles may have to be cut into suitable sizes for covering different wall spaces. Different cutting tools and scratchers shall be used for cutting tiles or scratching lines on tiles for cutting.

SUMMARY OF THE INVENTION

The present invention provides a three-purpose tile cutting pliers which is applicable for cutting small and big tiles and for scratching lines on big tiles for cutting. According to the preferred embodiment of the present invention, the tile cutting pliers comprises a base handle and an actuating handle pivotably connected together by a pivot and a return spring and terminating in a respective cutter blade for cutting small tiles, wherein the base handle has a triangular stop bar longitudinally disposed at an inner side; the actuating handle has a scratcher for cutting scratches on big tiles, a jaw plate and two needle holders longitudinally spaced at an inner side and moved relative to the longitudinal stop bar to cut big tiles along the scratches cut thereon.

DETAILED DESCRIPTION OF THE PREFERRED EMBODIMENT

Figure 1A:
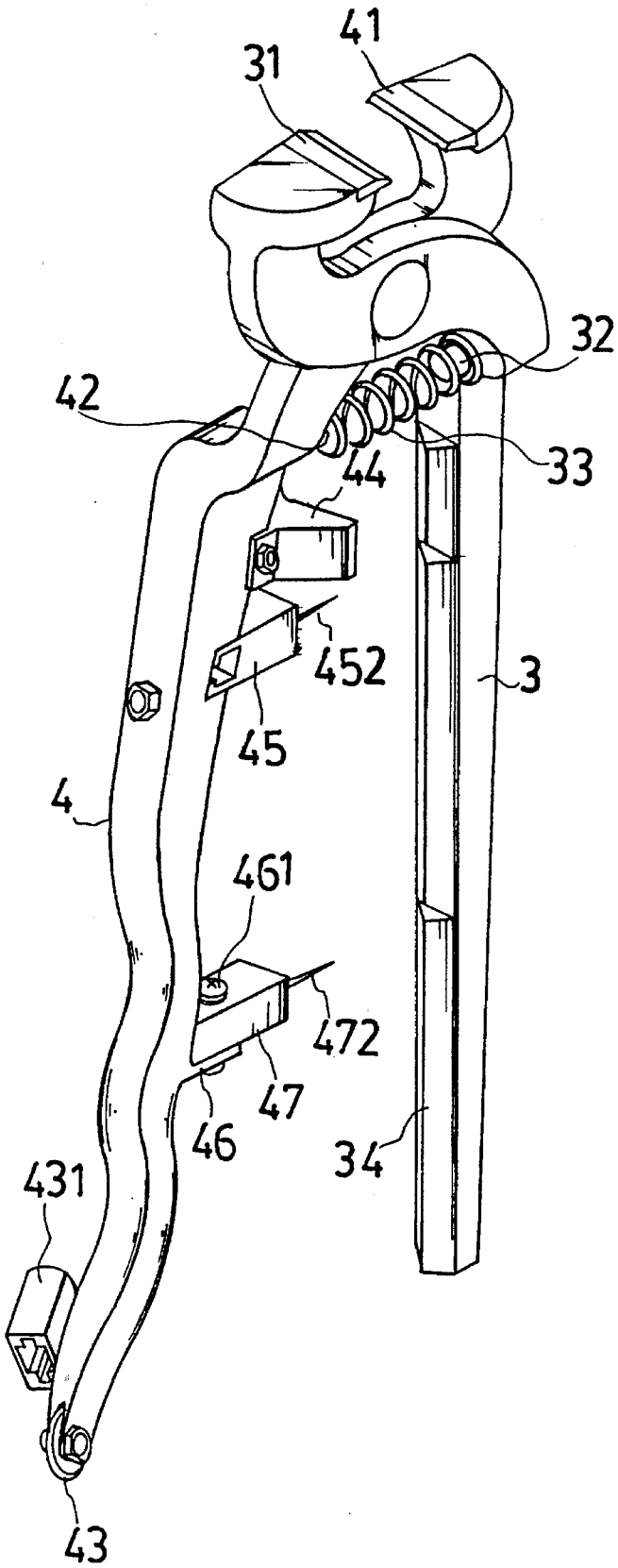
FIG. 1A is an elevational view of a three-purpose tile cutting pliers according to the present invention.
Figure 1B:
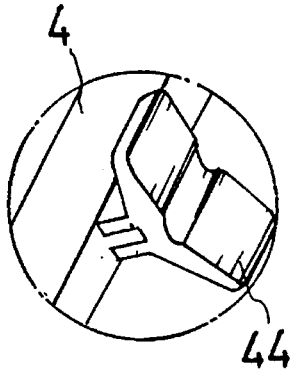
FIG. 1B shows the structure of the triangular jaw plate on the actuating handle of the tile cutting pliers.
Figure 1C:
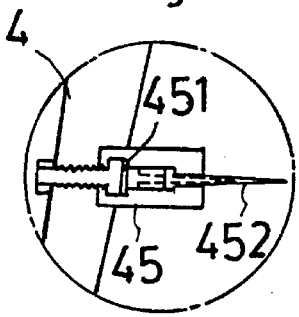
FIG. 1C shows the structure of the front needle holder one the actuating handle of the tile cutting pliers.
Figure 1D:
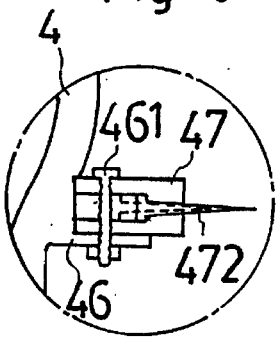
FIG. 1D shows the structure of the rear needle holder on the frame of the actuating handle of the tile cutting pliers.
Figure 1E:
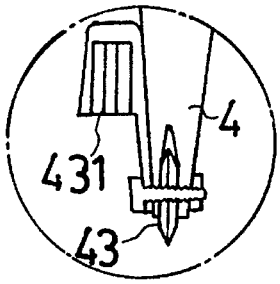
FIG. 1E shows the structures of the scratcher and the cap on the actuating handle of the tile cutting pliers.

Referring to FIGS. 1A, 1B, 1C, 1D, and 1E, a three-purpose tile cutting pliers in accordance with the present invention is generally comprised of a base handle 3 and an actuating handle 4 pivotably connected together. The base handle 3 and the actuating handle 4 have a respective front jaw welded with a respective tungsten steel cutter blade 31 or 41, and a respective projecting rod 32 or 42 facing toward each other and disposed near the pivot joint at an opposite side relative to the cutter blades 31 and 41. A return spring 33 is connected between the projecting rods 32 and 42 to automatically open the pliers. The cutter blades 31 and 41 are horizontally disposed against each other so that they cut as they come together. The base handle 3 further comprises a triangular stop bar 34 longitudinally disposed at an inner side. The actuating handle 4 is orthopedically engineered for a comfortable grip, having a scratcher 43 and a cap 431 at the bottom end. The cap 431 is hinged to the actuating handle 4 so that it can be releasably covered on the scratcher 43. The actuating handle 4 further comprises a substantially triangular jaw plate 44, a front needle holder 45, and a frame 46 longitudinally spaced at an inner side. The front needle holder 45 has a substantially T-shaped slot 451, which holds a front steel needle 452. A rear needle holder 47 is fastened to the frame 46 by a bolt 461 to hold a rear steel needle 472.

Figure 2:
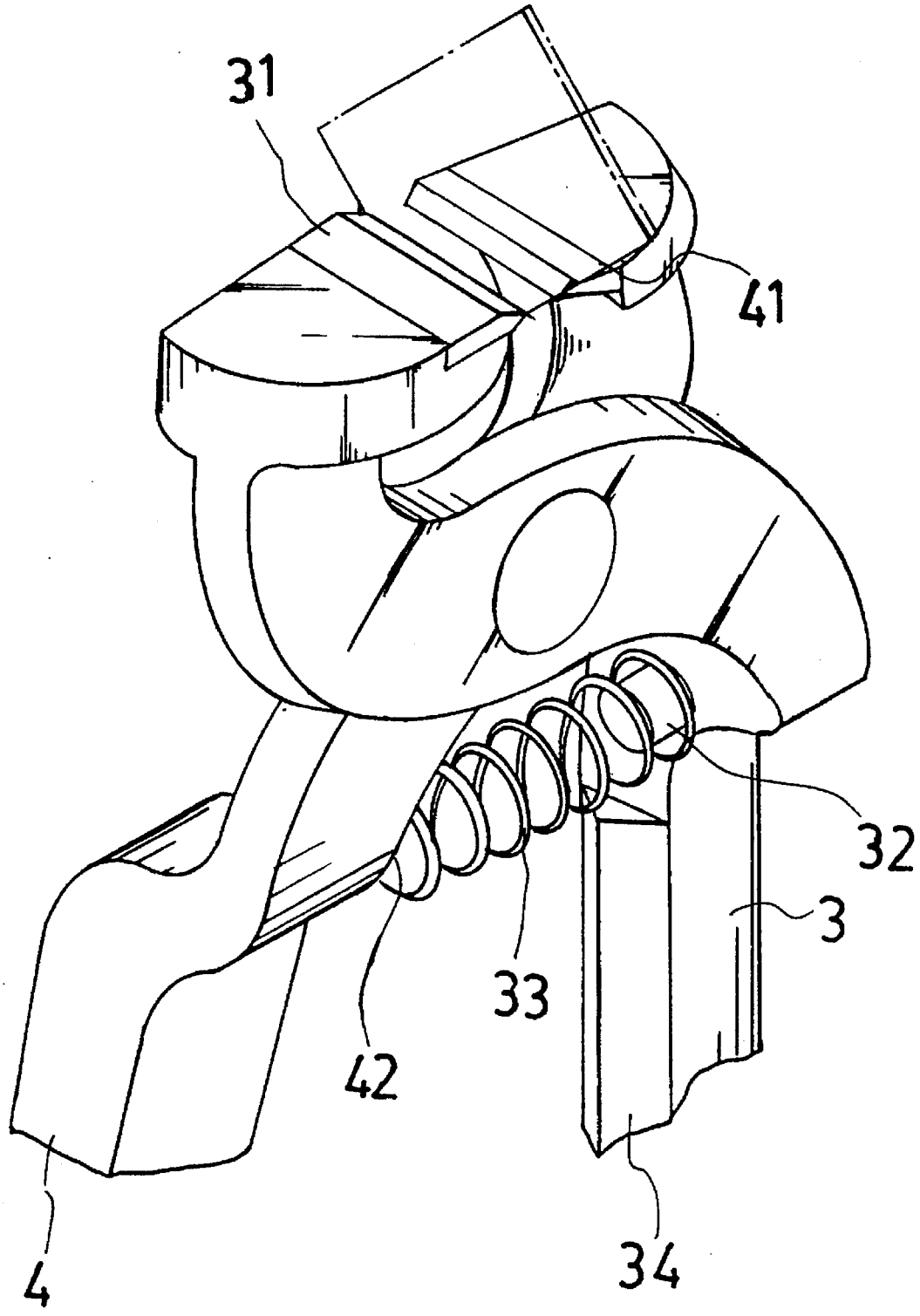
FIG. 2 shows the cutter blades of the tile cutting pliers acted against each other to cut a small tile.

Referring to FIG. 2, the cutter blades 31 and 41 can be acted against each other to cut small tiles.

Figure 3:
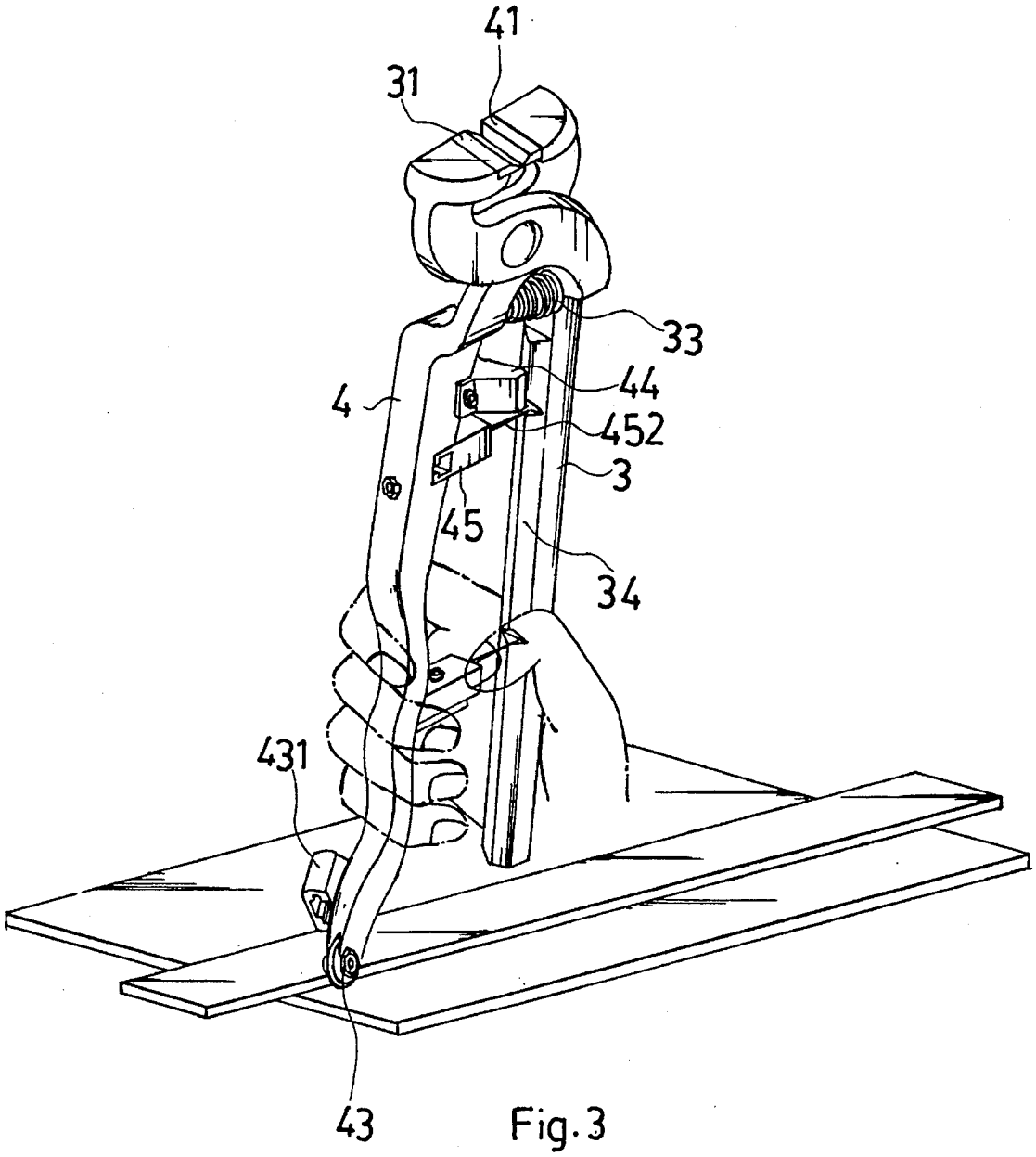
FIG. 3 shows the scratcher of the tile cutting pliers moved on a big tile to cut a line of scratch.
Figure 4:
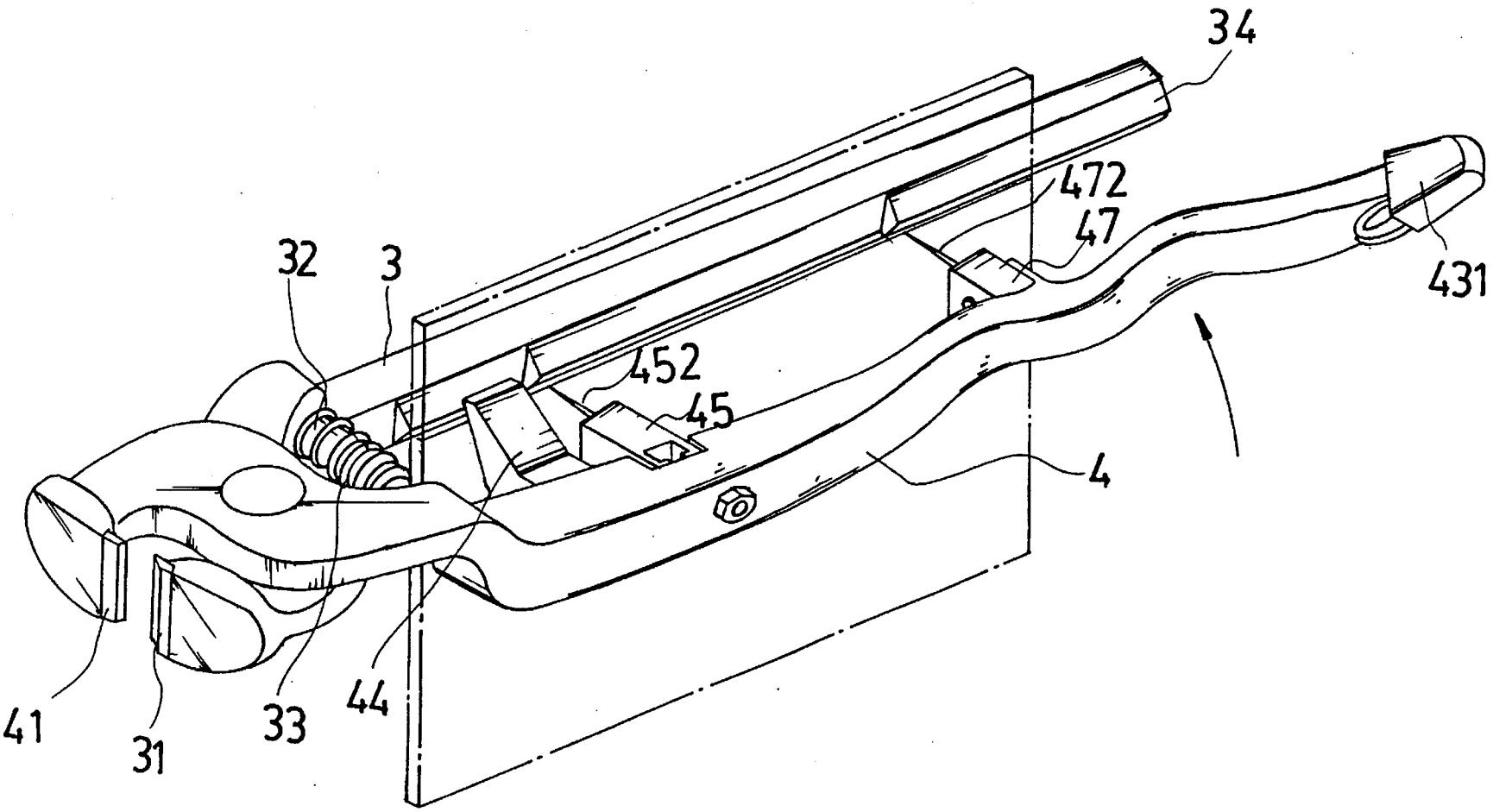
FIG. 4 shows the tile cutting pliers operated to cut a big tile.
Figure 5:
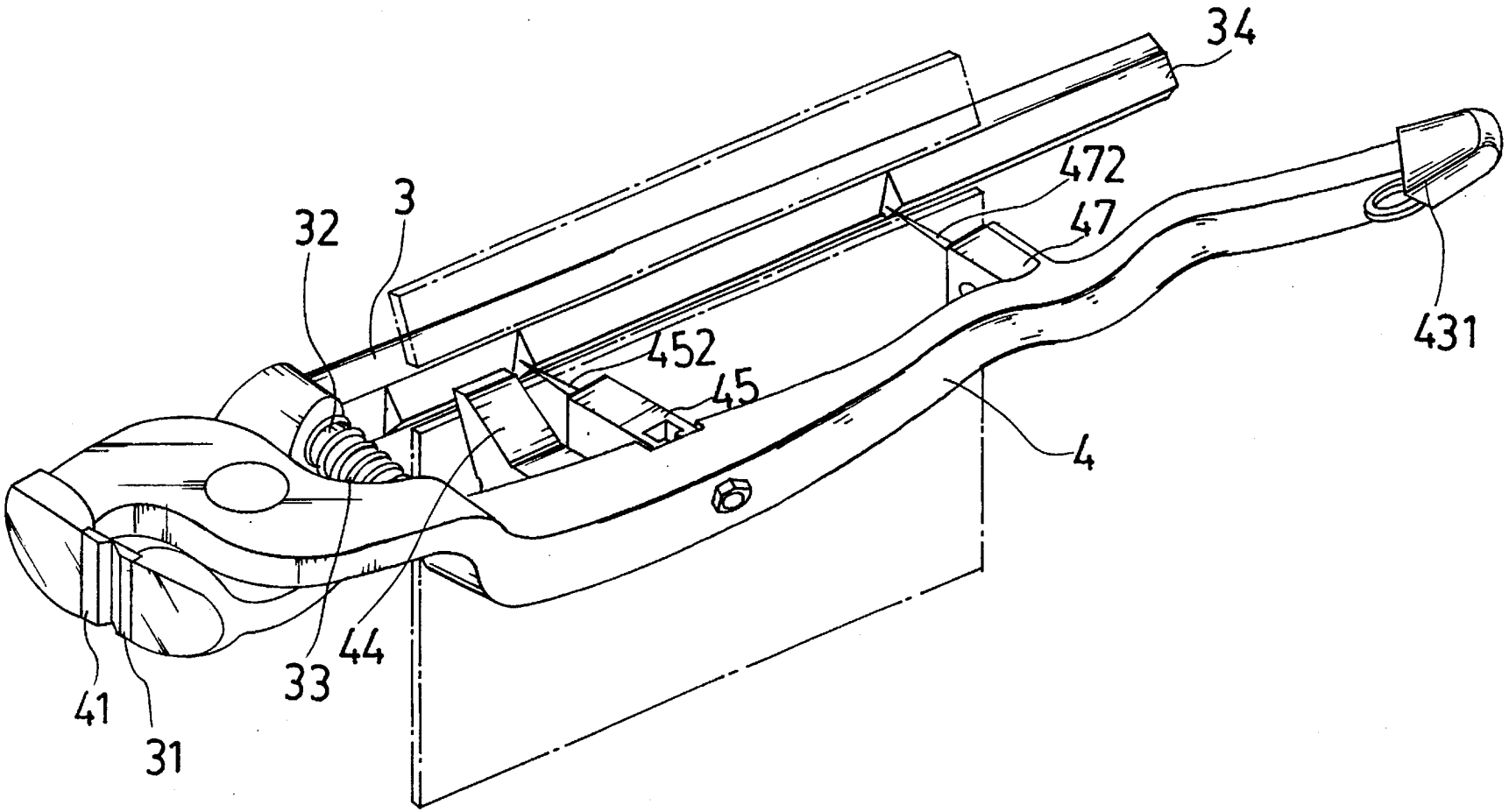
FIG. 5 is similar to FIG. 4 but showing the tile out.

Referring to FIGS. 3 and 4, when to cut a big tile, the scratcher 43 of the actuating handle 4 is used to cut a line on the tile according to the size required (see FIG. 3), then the tile is supported on the stop bar 34 of the base handle 3, and then the actuating handle 4 is moved toward the tile, permitting the front and rear steel needles 452 and 472 to pierce the line of scratch on the tile, and therefore the tile is accurately cut when the front and rear steel needles 453 and 472 are forced into the line of scratch.

I claim:

1. A three-purpose tile cutting pliers comprising a base handle and an actuating handle pivotably connected together by a pivot and a return spring, two cutter blades respectively welded to said base handle and said actuating handle at one end and moved relative to each other by said base handle and said actuating handle to cut things as they come together, and a scratcher securely fixed to said actuating handle at an opposite end relative to the corresponding cutter blade, wherein said base handle comprises a triangular stop bar longitudinally disposed at an inner side; said actuating handle comprises a substantially triangular jaw plate, a front needle holder, and a rear needle holder longitudinally spaced at an inner side and moved with said actuating handle to act against said triangular stop bar, said front and rear needle holders each holding a respective steel needle facing toward said triangular stop bar.

* * * * *